US006705029B2

(12) United States Patent
Anderson

(10) Patent No.: US 6,705,029 B2
(45) Date of Patent: Mar. 16, 2004

(54) TRENCHING MACHINE

(76) Inventor: Richard A. Anderson, 419 Elias Guidry Rd., Lafayette, LA (US) 70506

( * ) Notice: Subject to any disclaimer, the term of this patent is extended or adjusted under 35 U.S.C. 154(b) by 0 days.

(21) Appl. No.: 10/101,864

(22) Filed: Mar. 21, 2002

(65) Prior Publication Data

US 2003/0177670 A1 Sep. 25, 2003

(51) Int. Cl.[7] ..... E02F 3/88; F16L 1/12

(52) U.S. Cl. ..... 37/323; 226/170; 226/174; 405/160; 405/162; 405/163

(58) Field of Search ..... 37/307, 309, 311, 37/313, 314, 316, 317–326, 332, 334–339, 342–344; 405/163, 154, 158–162, 164–166, 168.4, 174–184; 226/168, 170–174; 100/151–154, 118–120

(56) References Cited

U.S. PATENT DOCUMENTS

| | | | | | |
|---|---|---|---|---|---|
| 3,103,790 | A | | 9/1963 | Popich | |
| 3,429,131 | A | | 2/1969 | Martin | |
| 3,751,927 | A | * | 8/1973 | Perot, Jr. | |
| 4,039,109 | A | * | 8/1977 | Rhodes | 226/172 |
| 4,087,981 | A | * | 5/1978 | Norman | |
| 4,112,695 | A | * | 9/1978 | Chang et al. | 405/163 |
| 4,117,689 | A | * | 10/1978 | Martin | 405/163 |
| 4,175,224 | A | | 11/1979 | Sims et al. | |
| 4,280,289 | A | | 7/1981 | Bassompierre-Sewrin | |
| 4,563,793 | A | * | 1/1986 | Ryan | 17/58 |
| 4,586,850 | A | | 5/1986 | Norman et al. | 405/163 |
| 4,687,422 | A | * | 8/1987 | Fuchs, Jr. | 417/345 |
| 4,806,049 | A | * | 2/1989 | Cour | 405/161 |
| 4,955,110 | A | * | 9/1990 | Ogawa | 17/53 |
| 5,009,353 | A | * | 4/1991 | Alquist | 226/172 |
| 5,288,172 | A | | 2/1994 | Reuhl | 405/163 |

FOREIGN PATENT DOCUMENTS

| | | | |
|---|---|---|---|
| DE | 4225474 C1 | * | 9/1993 |
| FR | 2311240 | * | 12/1976 |
| FR | 2695115 | * | 3/1994 |
| JP | 2003-3338 | * | 1/2003 |

* cited by examiner

*Primary Examiner*—Christopher J. Novosad
(74) *Attorney, Agent, or Firm*—Stevens, Davis, Miller & Mosher, LLP

(57) ABSTRACT

An apparatus for forming a trench in a seabed for burying a line generally consisting of a main frame, at least one buoyancy tank mounted on the main frame, a pair of endless track assemblies, each engageable in gripping relation with a side of the line for propelling the frame along the line, a pair of jet legs mounted on the main frame and communicable with a source of fluid under pressure, for ejecting high velocity streams of fluid to dislodge portions of the seabed when the track assemblies grip the line and propel the main frame along the line to form a trench and allow the line to fall therein.

43 Claims, 6 Drawing Sheets

13
15
10
14
12

TRENCHING MACHINE

This invention relates to an apparatus for forming a trench along the bed of a body of water and more particularly to a machine for forming a trench for burying a pipeline or cable lying along a seabed.

BACKGROUND OF THE INVENTION

In the energy, telecommunications and other industries, it has been a common practice to lay pipelines, cables and other types of conduits along seabeds for conveying fluids such as oil and gas and communications data from offshore rigs to a mainland and between mainlands. Typically, such conduits are first laid along the seabed and then are buried so as to avoid any damage thereto resulting in a loss of fluid conveyed or disruption of data transmitted therethrough.

In the prior art, there has been developed a number of machines for forming a trench for burying such conduits. Typically, such machines have consisted of a frame adapted to straddle a conduit lying along a seabed, means mounted on a machine frame and engageable with the conduit for propelling the machine along the conduit, means mounted on the machine for ejecting high velocity streams of water to dislodge the seabed along the conduit and thus form a trench into which the conduit is caused to fall as the machine is propelled along the conduit, and often means also mounted on the machine for educting spoils produced by the high velocity streams injected by the machine and thus facilitating the formation of the trench. Examples of such machines are illustrated and described in U.S. Pat. Nos. 3,751,927 to Joseph C. Perot, Jr., 4,087,981 to Robert M. Norman, 4,112,695 to Mike M. Chang et al and 4,117,689 to Charles F. Martin.

The conventional means for propelling such prior art trenching machines along a conduit to be buried has consisted of a set of rollers, one or more of which are adapted to be driven, usually by a hydraulic motor mounted on the machine frame. Such means of propulsion, however, has been found not to be entirely effective in providing uninterrupted and consistent travel of the trenching machine along the conduit. The use of rollers as a propulsion means has been found to be ineffective in providing sufficient traction with the conduit for propelling the machine along the conduit, particularly when the conduit is formed of a material with a smooth surface such as a plastic coating, causing damage to the conduit when the traction force is excessive and fractures the conduit often consisting of a concrete pipeline, and in negotiating projections on the conduits such as anodes commonly provided on underwater pipelines.

In a typical operation for burying a conduit lying along a seabed, there is provided a service barge, a submersible trenching machine adapted to be launched from the service barge and attached to the conduit and an umbilical line interconnecting pumps and compressors provided on the barge and the trenching machine. Operators of such barges and machines commonly are compensated by the linear footage of conduit buried. Interruptions of the trenching operations of such machines are very costly to such operators not only because of the loss of revenue in operation of the trenching machine but also because of the cost of operating the service barge and the equipment on board.

Accordingly, the principal object of the present invention is to provide an improved trenching machine of the type described which is operable to readily and positively grip a conduit lying along a seabed, propel the machine along such conduit at a steady and consistent rate of travel and easily negotiate any obstruction on the conduit without interrupting the travel of the machine.

SUMMARY OF THE INVENTION

The present invention provides an improved apparatus for forming a trench in the bed of a body of water for burying a conduit lying therealong which generally consists of a main frame, at least one buoyancy tank mounted on the main frame, a pair of endless track assemblies, each engageable with a side of the conduit being buried, in gripping relation, for propelling the frame along the conduit, and means mounted on the main frame and communicable with a source of fluid under pressure, for ejecting high velocity streams of fluid to dislodge portions of the bed lying below the conduit when the track assemblies grip and propel the main frame of the machine along the conduit to form a trench and allow the conduit to fall therein. Preferably, the fluid injecting means consists of a pair of jet legs mounted on the front end of the machine frame, provided with a plurality of forwardly and laterally directed nozzles for ejecting water under pressure for dislodging material from the seabed along the path of the conduit, and there further is provided a pair of eductors mounted at the rear end of the machine frame, having inlets for drawing spoils produced by the jet legs and ejecting such spoils laterally as the machine moves forwardly.

DETAILED DESCRIPTION OF AN EMBODIMENT OF THE INVENTION

Figure 1:
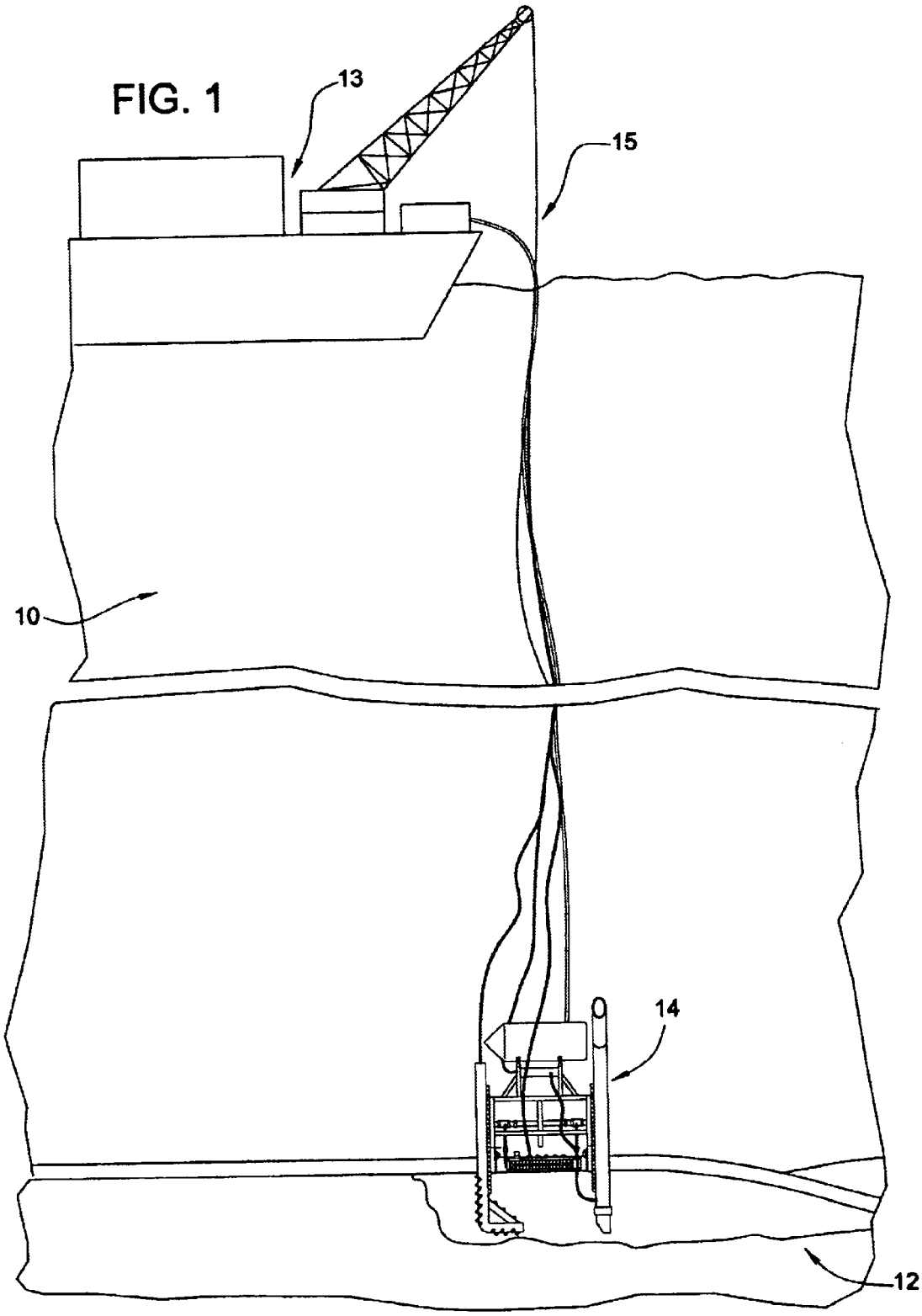
FIG. 1 is a side view of a service barge afloat on a body of water, a pipeline lying along the bed of such body of water, a trenching machine embodying the present invention operatively connected to such pipeline and a service line extending from the barge to the trenching machine.

Referring to FIG. 1 of the drawings, there is shown a body of water 10, a pipeline 11 lying along the bed 12 of the body of water, a service barge 13 stationed on the body of water above or adjacent the pipeline, a trenching machine 14 embodying the present invention, and a service line 15 commonly referred to as an umbilical cord interconnecting the service barge and the trenching machine for conveying water, air and hydraulic fluid under pressure from pumps and compressors and on the barge to the trenching machine. Generally, the machine includes a main support frame 16 adapted to straddle pipeline 11, a buoyancy assembly 17 mounted on the main support frame, a propulsion unit 18 mounted on the main support frame and operatively engageable with pipeline 11, an excavating assembly 19 mounted on the front end of the main support frame and an eductor assembly 20 mounted on the rear end of the main support frame.

Figure 2:
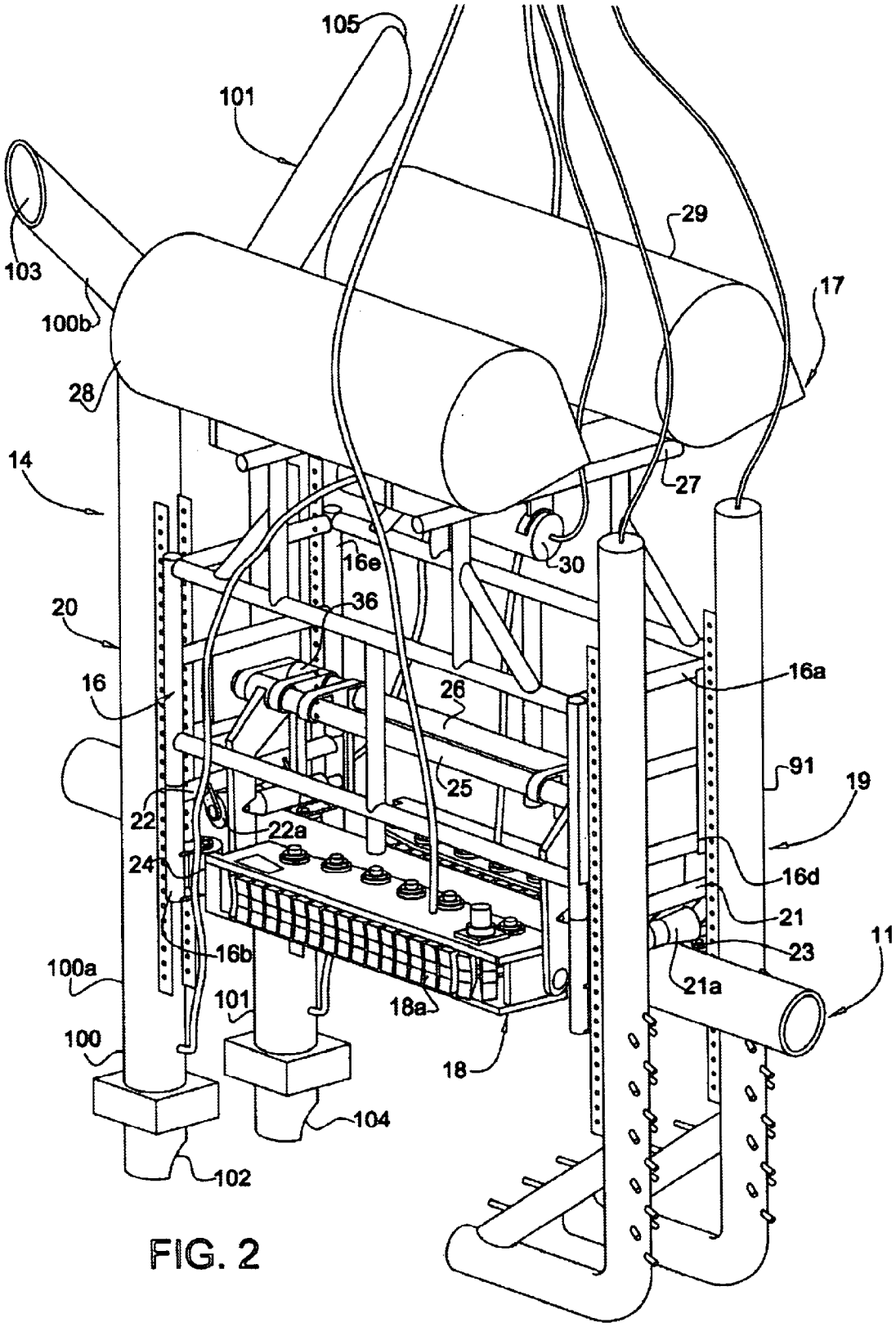
FIG. 2 is an enlarged, perspective view of the trenching machine shown in FIG. 1.
Figure 3:
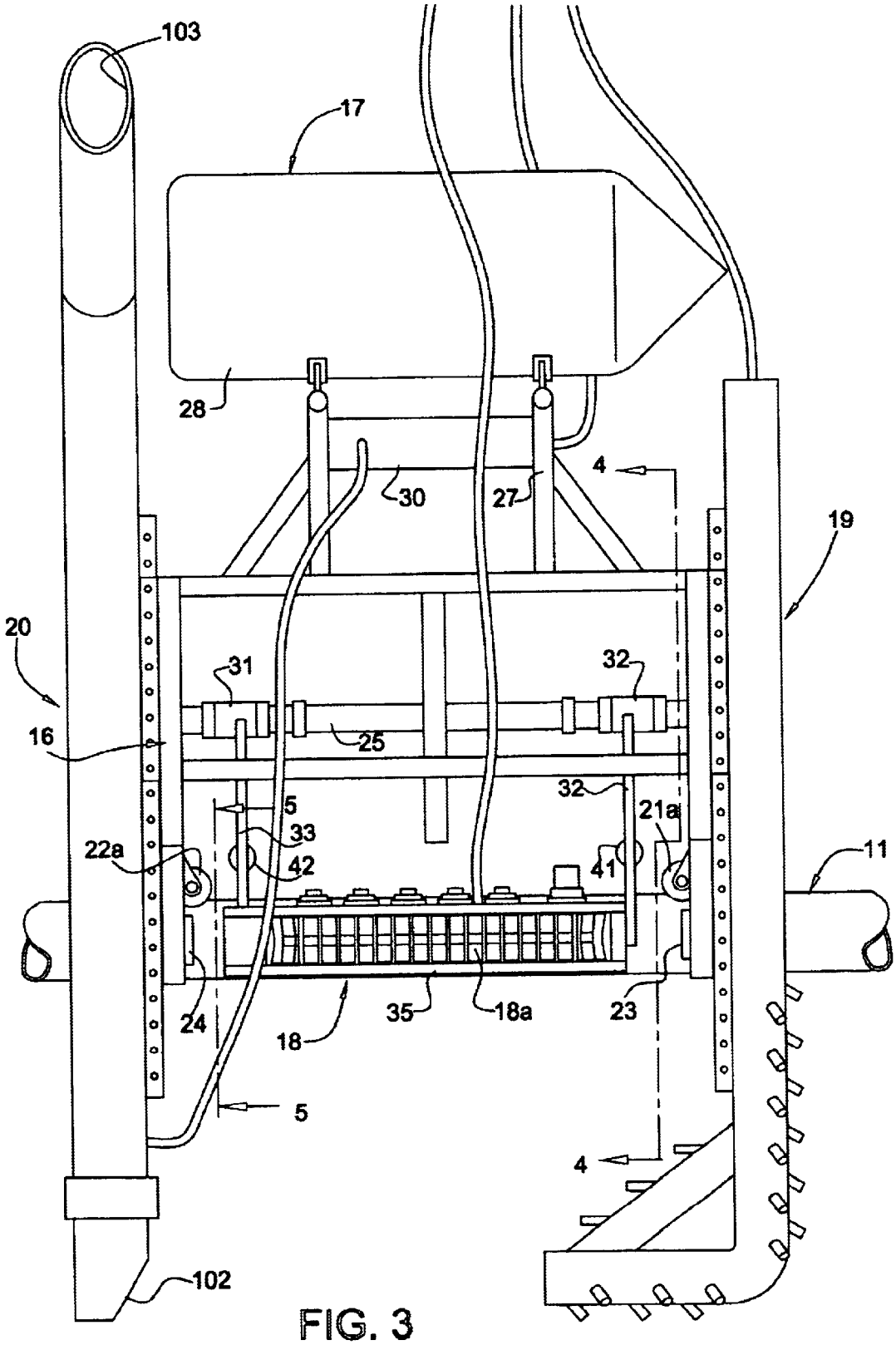
FIG. 3 is a side elevational view of the machine shown in FIG. 2.

Support frame 16 consists of a plurality of steel members welded together, having sufficient strength to support the various components of the machine yet small in cross sectional configuration to facilitate its travel through the water. It includes a substantially rectangularly configured upper section 16*a* having a set of corner members 16*b* through 16*e* extending below section 16*a* to provide a longitudinal opening in the support frame for receiving pipeline 11 therethrough. Disposed at the front and rear areas of frame section 16*a* is a set of transverse members 21 and 22 provided with depending brackets supporting a pair of longitudinally spaced rollers 21*a* and 22*a*. Such rollers are adapted to seat on pipeline 11 when the machine is mounted thereon in straddling relation as shown in FIGS. 2 and 3, to align the propulsion assembly vertically with the pipeline. The diameter and configuration of each of such rollers is selected to accommodate pipelines of different diameters. They further are formed of a material sufficiently compressible and/or are displaceable to allow them to negotiate past any protrusion on the pipeline so as not to interfere with the travel of the machine along the pipeline. Similarly mounted on the depending leg portions of frame section 16*a* is a first set of brackets supporting a first set of rollers 23, 23, and a second set of brackets supporting a set of transversely spaced rollers 24, 24. The sets of rollers 23, 24 are adapted to engage the side portions of a pipeline segment extending through the longitudinal opening of the support frame to align the propulsion assembly transversely relative to the pipeline. Such rollers of different diameters are used to accommodate pipelines of different diameters. They also are formed of a material or mounted to permit them to pass over any protrusions on the pipeline as the machine is propelled along the pipeline. The function of longitudinally spaced rollers 21*a* and 22*a* and transversely spaced rollers 23 and 24 is merely to align the propulsion unit on the pipeline vertically and transversely when the machine is mounted on the pipeline as shown in FIGS. 2 and 3.

Frame section 16*a* further is provided with a pair of longitudinally disposed, transversely spaced rod members 25 and 26 disposed above the lower end thereof, which support propulsion assembly 18, and a platform portion 27 on the upper end thereof which supports buoyancy assembly 17.

Buoyancy assembly 17 consists of a pair longitudinally disposed, transversely spaced tanks 28 and 29 rigidly mounted on platform portion 27 of the support frame. Such tanks are symmetrically positioned relative to a centerline of the support frame. Each of the tanks is substantially cylindrical in configuration having conically configured front-end portions to facilitate their travel through the water. Mounted on and depending from platform portion 27 is an air manifold 30 adapted to service the buoyancy tanks and the eductor assembly. The manifold is connected through an air hose forming part of the umbilical cord, to a compressor provided on the service barge. In the conventional manner, compressed air may be supplied to or vented from the buoyancy tanks to control the buoyancy effect of the tanks.

Figure 4A:
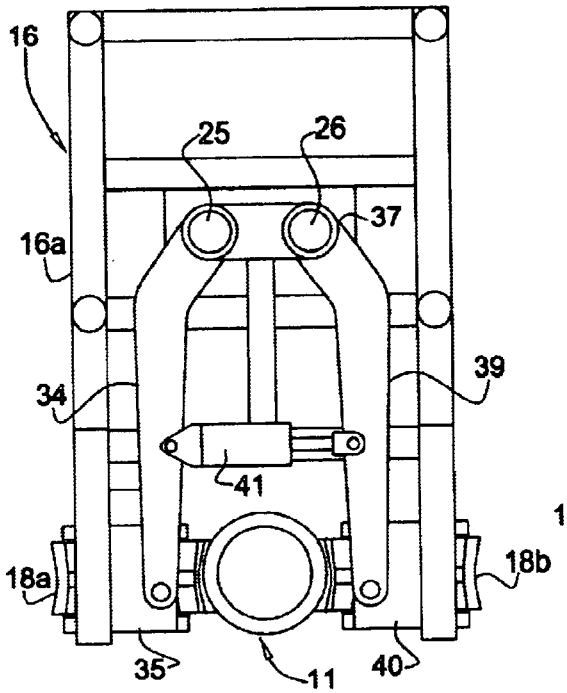
FIG. 4A is a cross-sectional view taken along line 4—4 in FIG. 3, illustrating the traction assemblies of the machine gripping a pipeline as when in an operational mode.
Figure 4B:
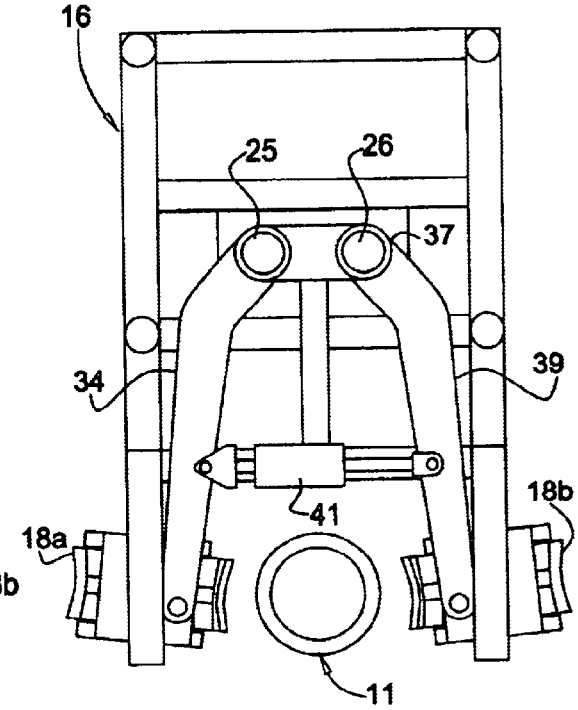
FIG. 4B is a view similar to the view shown in FIG. 4A, illustrating the traction assemblies disengaged from the pipeline in a nonoperational mode.
Figure 5:
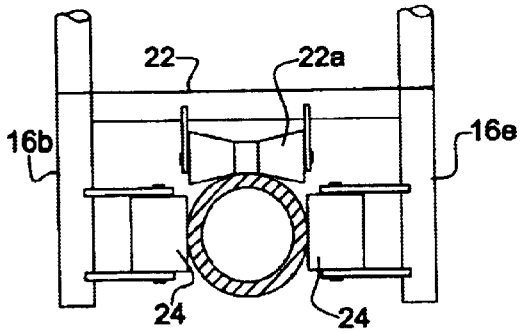
FIG. 5 is a cross-sectional view taken along line 5—5 in FIG. 3.

Propulsion assembly 18 is supported on main frame 16 and is adapted to engage pipeline 17 when the machine is mounted on the pipeline in straddling relation as shown in FIGS. 2 and 3 for propelling the machine along the pipeline. The assembly consists of a pair of substantially identical track assemblies 18*a* and 18*b* which are pivotal about the longitudinal axes of members 25 and 26, into and out of engagement with pipeline 11, when the machine is mounted on the pipeline as shown in FIGS. 2 and 3. As best shown in FIGS. 3, 4A and 4B, track assembly 18*a* includes a set of bushings 31 and 32 mounted on rod member 25, a pair of depending arm members 33 and 34 rigidly connected to bushings 31 and 32, respectively, and a track housing 35 mounted on the lower ends of such arm members. Similarly, track assembly 18*b* includes a set of bushings 36 and 37, a pair of depending arms 38 and 39 rigidly connected at their upper ends on bushings 36 and 37 and a track housing 40 pivotally mounted on the lower ends of depending arm members 38 and 39. Track housings 35 and 40 are substantially identical in construction and operation. The track assemblies are adapted to be displaced relative to each other about the axes of rod members 25 and 26, into and out of engagement with a segment of pipeline 11, when the machine is mounted on the pipeline, by means of a first fluid actuated cylinder assembly 41 operatively interconnecting arm members 34 and 39 and a similar fluid actuated cylinder assembly 42 operatively interconnecting arm members 33 and 38.

Figure 6:
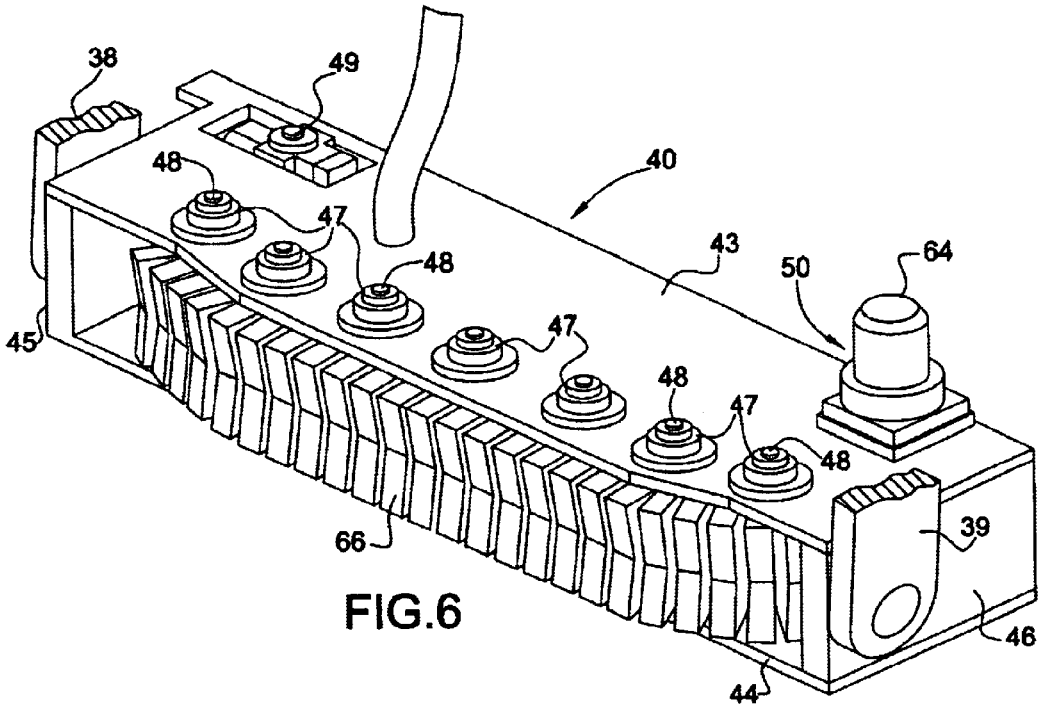
FIG. 6 is an enlarged, perspective view of a traction assembly used in the machine shown in FIGS. 2 and 3.
Figure 7:
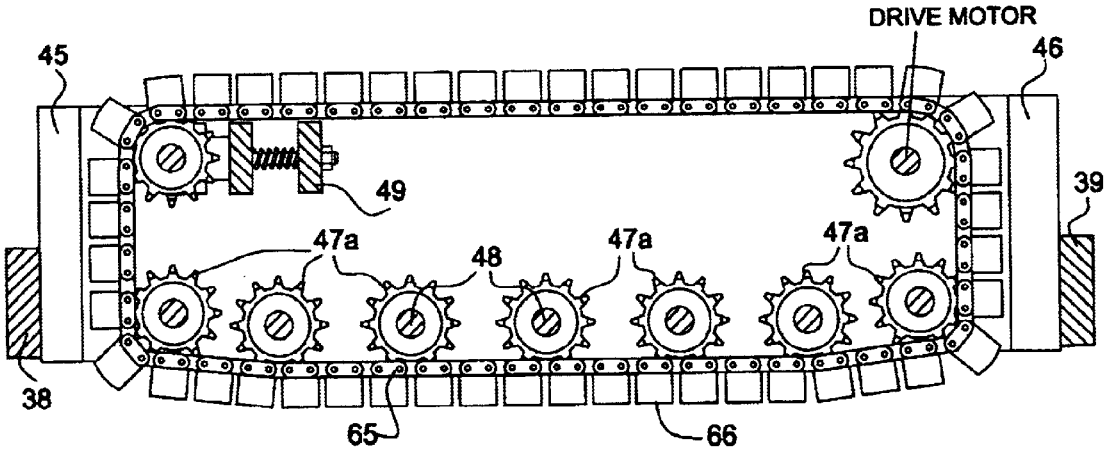
FIG. 7 is an enlarged, top plan view of the traction assembly shown in FIG. 6, having an upper plate portion thereof removed.
Figure 8:
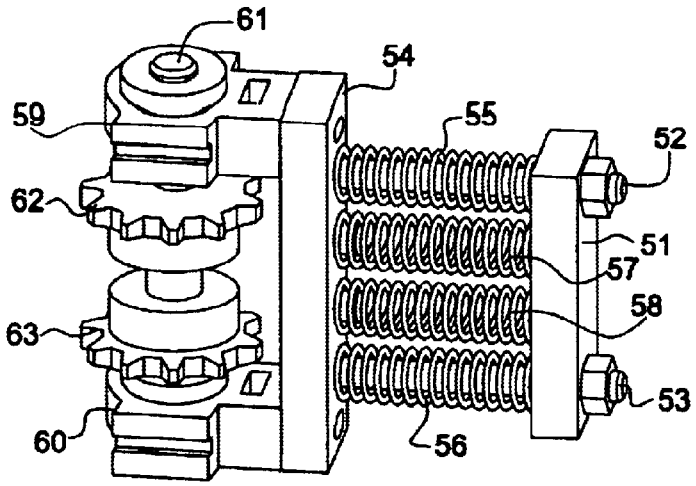
FIG. 8 is an enlarged, perspective view of a tensioning assembly used in the traction assembly shown in FIGS. 6 and 7.

As best seen in FIGS. 6, 7 and 8, track housing 40 includes upper and lower plate members 43 and 44 and a pair of end plate members 45 and 46. Mounted along one side of the upper and lower plate members are sets of bearings 47 in which there are journaled a plurality of shafts 48. Each of such shafts is provided with a pair of axially spaced sprockets 47*a* and 47*b*. On the inner side of track housing 40, adjacent end wall 45, is a tensioning assembly 49, and also mounted on the outer side of track housing 40, adjacent end wall 46, is a drive assembly 50.

Referring to FIG. 8, tensioning assembly 49 includes a stationary base member 51 rigidly secured at its upper and lower ends to upper and lower plate members 43 and 44, a pair of vertically spaced rod members 52 and 53 rigidly secured at one set of ends thereof to base member 51, a carrier member 54 having openings therein receiving rod members 52 and 53 therethrough to permit carrier member 54 to displace on rod members 52 and 53 relative to base member 51, a first set of springs 55 and 56 disposed on rod members 52 and 53, respectively, between members 51 and 54, and a second set of springs 57 and 58 also disposed between members 51 and 54 for biasing carrier member 54 away from base member 51. Mounted on the ends of carrier member 54 is a set of bearing blocks 59 and 60 in which there is journaled an idler shaft 61. Formed on the intermediate portion of shaft 61 is a pair of axially spaced sprocket portions 62 and 63 which lie in the same planes as sprockets 47*a* and 47*b* of idler shafts 47.

Drive assembly 50 consists of a hydraulic fluid motor 64 mounted on upper plate member 43, having a drive shaft provided with a set of sprocket portions disposed in the same planes as sprocket portions 62 and 63 of assembly 49 and sprocket portions 47*a* and 47*b* of idler shafts 47.

Trained about the sets of sprockets of the drive and idler shafts is a set of endless chains 65, 65. Such chains are provided on the outer sides thereof with a plurality of pads 66. As best shown in FIGS. 6 and 7, idler shafts 47 are disposed sufficiently close to the inner sides of plate members 43 and 44 so that the pads along the inner flight of the endless track will project inwardly, beyond the inner edges of plate members 43 and 44 to engage a side portion of a pipeline segment without interference from plate members 43 and 44. Pads 66 are formed of a compressible material, preferably Neoprene, and are adapted to grip a segment of the pipeline when urged against it to provide a traction force between the track assembly and the pipeline for propelling the machine along the pipeline as motor 50 is operated to drive the endless track. Slack in the endless track is compensated for by tensioning assembly 49.

Figure 9:
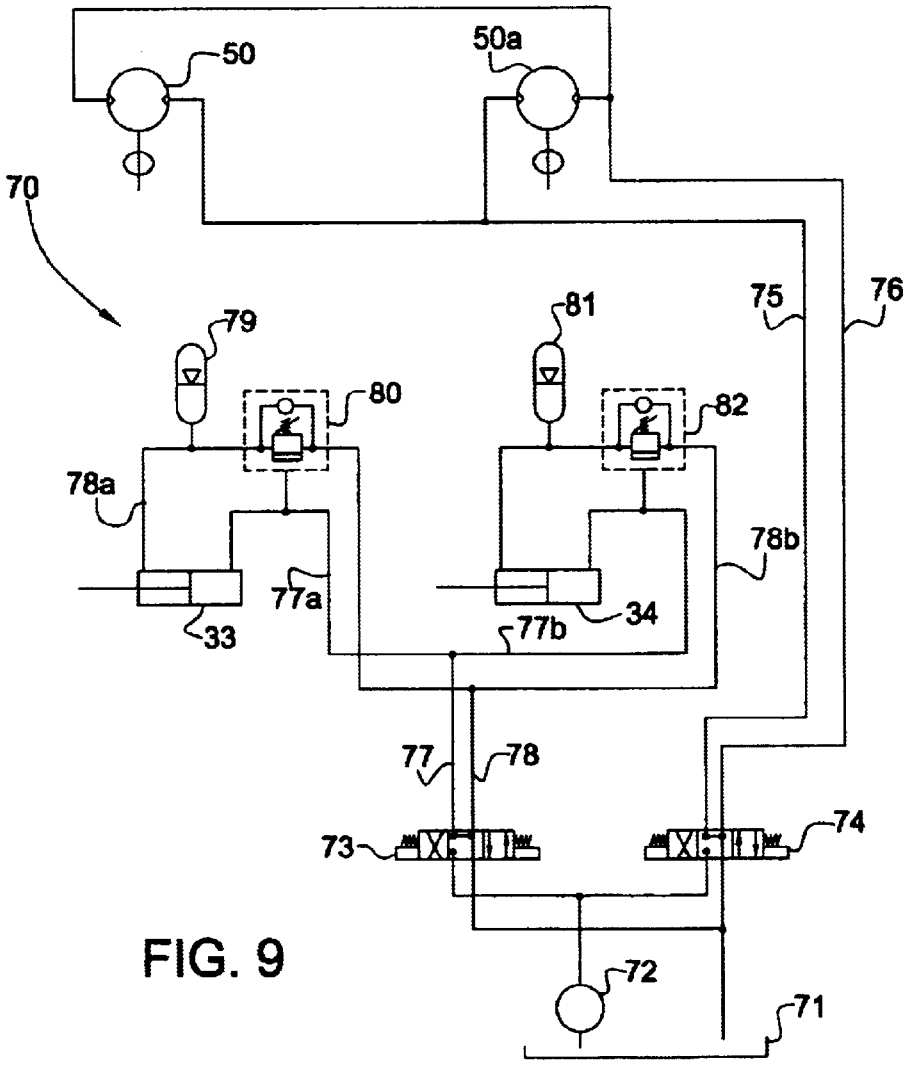
FIG. 9 is a schematic of the hydraulic system utilized with the machine shown in FIGS. 2 through 7 for operating the traction assemblies.

The displacement of the track assemblies into and out of engagement with a segment of the pipeline disposed within the support frame, and the operation of fluid motor 50 is controlled by a hydraulic fluid system 70 shown in FIG. 9. The system includes a hydraulic fluid reservoir 71, a hydraulic fluid pump 72 and a pair of selector valves 73 and 74 mounted on the surface barge, cylinder assemblies 33 and 34 and hydraulic fluid motors 50 and 50*a* mounted on track assemblies 18*a* and 18*b* and interconnecting hoses forming part of the umbilical cord. A pair of supply and return lines 75 and 76 including selector valve 74 and suitable branch lines interconnect the pump and reservoir and drive motors 50 and 50*a*. Supply and return lines 77 and 78 including selector valve 73 and suitable branch lines interconnect the pump and reservoir and fluid cylinders 33 and 34. Provided in branch line 78*a* communicating with the rod end of fluid cylinder 33 is an accumulator 79 and a relief valve 80 responsive to a predetermined pressure in branch line 77*a* communicating with the base end of cylinder assembly 33. Similarly, branch line 78*b* communicating with the rod end of cylinder assembly 34 includes an accumulator 81 and a relief valve 82 responsive to a predetermined pressure in a branch line 77*b* communicating with the base end of cylinder assembly 34.

In the use of control system 70 to operate the machine, it will be appreciated that selector valve 73 may be operated to extend and retract cylinder assemblies 33 and 34 to correspondingly cause track assemblies 18*a* and 18*b* to displace into and out of engagement with a pipeline segment extending through the machine, and selector valve 74 may be operated when the track assemblies engage the pipeline to cause the machine to be propelled in either forward or rearward directions along the pipeline. Whenever the track assemblies encounter an obstacle on the pipeline such as an anode, accumulators 79 and 81 function to allow the cylinder assemblies to extend and thus allow the track assemblies to ride over the obstacle. The system allows the machine to firmly grip and provide suitable traction on the pipeline, propel the machine along the pipeline in either the forward or rearward direction and overcome any obstacle on the pipeline while continuing to grip the pipeline and be propelled therealong.

Excavating assembly 19 consists of a pair of L-shaped tubular members 90 and 91 or what are commonly referred to as jet legs, mounted on the front end of the support frame and spaced transversely. Each of such members is provided with an elongated, vertical section having a segment along a rear side thereof received in a channel provided on a corner member of the main frame which permits the entire member to be displaced relative to the main frame, a rearwardly extending section formed substantially at a right angle to the elongated section and a section interconnecting the elongated and lower sections. Pins or bolts may be inserted in registered openings in such channel member and protruding segment to secure the leg at a desired position relative to the main frame. Each member is tubular and is supplied with water under pressure through a hose connected to a pump on the service barge, which forms part of the umbilical cord. The forwardly facing portion of the elongated section of each member 90 and 91 is provided with a plurality of nozzles communicating with the interior of the section for directing high velocity streams of water forwardly and laterally for dislodging seabed material along and below the pipeline to form a trench into which the pipeline is caused to fall and be buried as the machine is propelled along the pipeline. Preferably, such nozzles are spaced along the elongated section of each member 90 and 91. Some of such nozzles are positioned to direct jets of water directly ahead in a vertical plane and other jets are positioned to direct jets of water laterally in planes displaced at an angle in the range of 15 to 25 degrees relative to the plane of the first set of jets. Such nozzles also may be positioned in horizontal planes or in planes angularly displaced from horizontal planes. As best shown in FIG. 3, the bottom side of the lower section of each member 90 and 91 also is provided with a set of nozzles for directing streams of high pressure water in a downward direction, and each interconnecting section is provided with a set of nozzles positioned to direct jets of water in a rearward direction.

As best shown in FIGS. 2 and 3, eductor assembly 20 consists of a pair of tubular members 100 and 101 mounted on the rear end of the support frame and spaced transversely. Tubular member 100 includes an elongated section 100*a* disposed in longitudinal alignment with the elongated section of member 90, and an upper, laterally angled section 100*b*. The forwardly facing portion of section 100*a* is provided with an elongated segment received within a channel shaped portion of a corner component of the support frame to permit tubular member 100 to be adjusted vertically relative to the support frame. The position of each of such members also may be secured relative to pins or bolts inserted in registered holes in such channel member and segment. The lower end of member 100 is provided with a forwardly opening inlet 102 disposed substantially in longitudinal alignment with the lower section of member 90, and the upper end of such member is provided with a laterally opening outlet 103. Eductor member 101 is similar in construction to eductor member 100. It includes an elongated section disposed in longitudinal alignment with the elongated section of member 91, and forwardly opening inlet 104 at the lower end thereof disposed in longitudinal alignment with the lower section of tubular member 91 and a laterally opening outlet 105.

A pair of air hoses interconnect air manifold 30 and the lower ends of the eductor members for injecting high velocity streams of air up through each of the eductor members which function to draw mixtures of water and spoils produced by jet legs 90 and 91 therethrough, and discharge such mixtures of water and spoils laterally through outlets 103 and 105 to clean the trench formed by the jet legs and allow the pipeline to fall and position on the bottom of the trench.

When it is desired to use the trenching machine as described to bury a pipeline laid along a seabed such as from an offshore drilling rig to a facility on shore, the machine will be loaded on a barge and transported to a point along and above the pipeline such as pipeline 11 shown in FIG. 1. Before the machine is placed in the water, the jet legs and eductor tubes are positioned relative to the main frame, properly sized rollers 21*a*, 22*a*, 23 and 24 are mounted on the main frame and the control system is operated to displace the track assemblies apart. The amount of displacement of the jet legs and eductor tubes relative to the support frame will determine the depth of the trench to be formed. The sizes and configurations of the positioning rollers will depend on the diameter of the pipeline to be buried and possibly the nature of the material of the pipeline. The track assemblies are spread apart to permit the machine to be positioned on the pipeline with a segment of the pipeline extending through the longitudinal opening in the lower end of the main frame.

When the machine is thus properly adjusted, a crane on the service barge may be used to place it in the water. Once placed in the water in a vicinity near the selected starting point of the pipeline to which the machine is to be connected, air in buoyancy tanks 28 and 29 may be vented to permit the machine to descend into the water as the umbilical cord connected to the machine is paid out. As the machine descends toward the starting point of the pipeline, divers may or may not be sent down to guide the machine down to the seabed so that the jet legs and eductor tubes rest on the seabed straddling the pipeline. With the divers then clear of the machine and preferably having returned to the barge, suitable controls on the barge are operated to supply water under pressure to the jet legs and air under pressure to the air manifold and then to the eductor tubes. Under such conditions, the nozzles positioned on the lower sections of the jet legs will begin to dislodge seabed below the machine to eventually cause the machine to descend positioning rollers 21*a* and 22*a* to seat on the pipeline and positioning rollers 23 and 24 to align the machine transversely. Spoils generated by the jet streams produced by the jet legs will be drawn through the lower inlets of the eductor tubes and directed laterally clear of the cavity into which the machine settles.

Once the machine is thus properly positioned on the pipeline, selector valve 73 may be operated to displace track assemblies 18*a* and 18*b* inwardly into gripping engagement with the pipeline. The machine then is in condition to begin forming a trench and burying the pipeline. This may be accomplished simply by operating selector valve 74 to cause the track assemblies to operate and thus cause the machine to crawl along the pipeline. As the machine moves forwardly, the jet legs will eject streams of high velocity water toward the seabed to dislodge the seabed material and thus form a trench into which the pipeline will be caused to fall and eventually become buried. Spoils produced by the jet legs will be drawn through the lower inlets of the eductor tubes to thus assure a clean bottom of the trench formed to further assure laying the pipeline at a desired depth below the seabed surface. If for any reason it is desired to reverse the direction of the machine, selector valve 74 simply may be operated to reverse the directions of fluid motors 50 and 50*a*.

As the machine advances along the pipeline and incurs an obstacle such as an anode, the positioning rollers will compress and/or displace sufficiently to permit them to override the obstacle. When the inner flights of the track assemblies encounter such an obstacle they will continue to exert a traction force on the sides of the pipeline but will be permitted to displace outwardly, in the order of a few inches, and override such obstacles as permitted by fluid in the rod ends of cylinder assemblies 33 and 34 being permitted to flow into accumulators 79 and 81.

When the pipeline operation has been completed and it is desired to retrieve the machine, selector valve 74 may be operated to discontinue the operation of drive motors 50 and 50*a*, and selector valve 73 may be operated to displace the track assemblies from engagement with the pipeline. The supply of pressurized water and air to the jet legs and eductor tubes may then be discontinued and air may be supplied to the buoyancy tanks to cause the machine to ascend to the surface. The crane aboard the barge may then be used to hoist the machine onto the deck of the barge. As the machine ascends, the umbilical cord connected to the machine correspondingly would be taken up and stored on the barge.

The main support frame may consist of a galvanized, carbon steel weldment. Because of the harsh and often corrosive environment in which the machine is used, suitable measures are required to be taken to avoid deterioration and dysfunction of the machine. The positioning rollers mounted on the main frame for locating the machine on a pipeline may be displaceable or spring loaded to allow them to accommodate anodes and other protrusions provided on the pipeline. The buoyancy tanks also are formed of galvanized carbon steel and are configured to allow the machine to travel freely along the pipeline. They are sized to provide a positive buoyancy. The propulsion assembly is intended to accommodate fluid pipelines and data transmission cables having outside diameters in the range of 4" to 20". The drive motor of each of the track assemblies preferably is a gear motor with an integral drain case. Since the chains of the track assemblies also will be operating in a harsh environment, they preferably are nickel coated. In addition, they would be provided with ears for bolting the pads thereon. The pads are intended to be compressible and vary in length, width and material. It further is contemplated that each of the track assemblies be provided with means for injecting water under pressure into the interior thereof to purge the areas around the sprockets and chains of spoils having migrated into the interiors of the assemblies. Such purging has the effect of prolonging the service lives of the sprockets and chains. Periodically, however, such chains will become worn and would have to be replaced.

The jet legs are intended to be displaced vertically relative to the main support frame in order to vary the depth of the trench to be formed. It is contemplated that the jet legs be sized to provide a 3' to 4' trench on each pass. It further is contemplated that instead of a single tubular conduit for each jet leg, a pair of such conduits may be provided. The drive system is designed to provide the track assemblies with a clamping pressure of 2,500 psi, supply the jet legs with 3000+ gpm of water at 1000 psi and further supply the eductors with 1600 cfm of air at 120 psi. The umbilical cord essential consists of a sheathed cluster of lines for conveying air, water and hydraulic fluid from the service barge to the trenching machine.

The invention as described provides a simple, compact and efficient machine which may be transported on a service barge to a suitable location at a pipeline lying along a seabed to be buried, placed in the water and lowered to a position astride the pipeline, operated to firmly grip the pipeline, advance along the pipeline and form a trench in which the pipeline is caused to fall into to be buried and easily detached and retrieved. It may be utilized to bury fluid pipelines normally used to transport oil and gas or cables normally used for electronic data transmissions. It further may be easily adjusted to vary the depth of the trench formed and to accommodate conduits of different diameters.

From the foregoing detailed description, it will be evident that there are a number of changes, adaptations and modifications of the present invention which come within the province of those persons having ordinary skill in the art to which the aforementioned invention pertains. However, it is intended that all such variations not departing from the spirit of the invention be considered as within the scope thereof as limited solely by the appended claims.

I claim:

1. An apparatus for forming a trench in the bed of a body of water for burying a line lying therealong, comprising:

a main frame;

at least one buoyancy tank mounted on said main frame;

a pair of endless track assemblies, each engageable in gripping relation with a side of said line for propelling said frame along said line; and means mounted on said main frame and communicable with a source of fluid under pressure, for ejecting streams of said fluid at sufficient velocities to dislodge portions of said bed when said track assemblies grip and propel said main frame along said line to form said trench and allow said line to fall therein.

2. An apparatus according to claim 1 including two buoyancy tanks disposed symmetrically on said main frame relative to a longitudinal axis of said main frame, and wherein said tanks are communicable with a supply of air and are provided with means for venting air therefrom for controlling the buoyancy thereof.

3. An apparatus according to claim 2 including means for controlling the supply of air to said buoyancy tanks.

4. An apparatus according to claim 1 wherein each of said track assemblies includes a support frame, at least one support arm member pivotally connected to said main frame for pivotal movement about a longitudinal axis, a plurality of shafts journaled in said support frame including a drive shaft and idler shafts, an endless track trained about said shafts, means mounted on said endless track engageable with said line along a flight of said track when said apparatus is in an operational mode and means for driving said drive shaft, and including means for selectively pivoting said track assemblies into and out of gripping relation with said line.

5. An apparatus according to claim 4 wherein said support frame includes a pair of spaced support plates and said shafts are journaled therein.

6. An apparatus according to claim 4 wherein one of said idler shafts is biased to provide tension on said track.

7. An apparatus according to claim 4 wherein each of said shafts is provided with a sprocket and said track comprises an endless chain received about said sprockets.

8. An apparatus according to claim 4 wherein said means for driving said drive shaft comprises a hydraulic motor communicable with a source of hydraulic fluid under pressure.

9. An apparatus according to claim 4 wherein said pivoting means includes a hydraulic cylinder assembly.

10. An apparatus according to claim 9 wherein said hydraulic cylinder assembly is included in a hydraulic fluid circuit including a pump, at least one control valve and an accumulator.

11. An apparatus according to claim 10 wherein said accumulator is operable to allow said track assembly to displace relative to said line when said apparatus is in an operational mode, and thus correspondingly allow said track assembly to override any protruding portion of said line.

12. An apparatus according to claim 4 wherein said pivoting means includes a hydraulic cylinder assembly operatively interconnecting arm members of said track assemblies.

13. An apparatus according to claim 12 wherein said hydraulic cylinder assembly is included in a hydraulic fluid circuit including a pump, at least one control valve and an accumulator.

14. An apparatus according to claim 13 wherein said accumulator is operable to allow said track assemblies to displace apart when said apparatus is in an operational mode and thus correspondingly allow said track assemblies to override any protruding portion of said line.

15. An apparatus according to claim 1 including means for pivotally displacing each of said track assemblies into and out engagement with said line.

16. An apparatus according to claim 15 wherein said pivoting means includes a hydraulic cylinder assembly.

17. An apparatus according to claim 16 wherein said hydraulic cylinder assembly is included in a hydraulic fluid circuit including a pump, at least one control valve and an accumulator.

18. An apparatus according to claim 17 wherein said accumulator is functional to allow said track assemblies to displace apart when said apparatus is in said operational mode, and thus correspondingly allow said track assemblies to override any protruding portion of said line.

19. An apparatus according to claim 1 wherein each of said track assemblies includes a support frame and an endless track disposed thereon having a flight disposed beyond said support frame, engageable with a segment of said line when said apparatus is in an operational mode.

20. An apparatus according to claim 1 wherein said fluid ejecting means comprises at least one vertically disposed conduit into which said fluid is supplied, having a plurality of nozzles spaced along the length thereof.

21. An apparatus according to claim 20 including a first set of nozzles directed in a substantially vertical plane, and second and third sets of nozzles each directed at an acute angle relative to said vertical plane.

22. An apparatus according to claim 21 wherein said acute angle is in the range of 15 degrees to 25 degrees.

23. An apparatus according to claim 20 wherein said conduit includes a set of nozzles directed rearwardly.

24. An apparatus according to claim 20 including a pair of said conduits, spaced transversely on each side of said line when said apparatus is disposed in an operational mode.

25. An apparatus according to claim 24 wherein each of said conduits includes a first set of vertically spaced nozzles lying in a vertical plane, directed forwarding, and second and third sets of nozzles, each of said second and third sets comprising vertically spaced nozzles lying in a plane disposed at an acute angle relative to said vertical plane.

26. An apparatus according to claim 25 wherein each of said conduits includes a set of nozzles directing fluid rearwardly.

27. An apparatus according to claim 20 wherein said conduit extends below said main frame.

28. An apparatus according to claim 1 including means mounted on said frame for educting spoils produced by the dislodgement of bed material by said ejector means.

29. An apparatus according to claim 28 wherein said educting means includes a forwardly opening inlet disposed at a lower end thereof, and a laterally opening outlet an upper end thereof.

30. An apparatus according to claim 28 wherein said educting means comprises a pair of transversely spaced conduits each disposed on a side of said line when said apparatus is in an operational mode.

31. An apparatus according to claim 30 wherein each of said conduits includes a forwardly opening inlet disposed at a lower end thereof, and a laterally opening outlet disposed at an upper end thereof, and means for injecting air upwardly into said conduit.

32. An apparatus according to claim 31 including an air manifold, means for conveying air from said manifold to said buoyancy tank and said conduits and means for controlling the supply of air from said manifold to said buoyancy tanks and said conduits.

33. An apparatus according to claim 1 wherein said line comprises a pipeline for conveying a fluid.

34. An apparatus according to claim 1 wherein said line comprises a cable for transmitting electrical signals.

35. An apparatus according to claim 1 including means for centering said main frame on said line.

36. An apparatus according to claim 35 wherein said centering means includes a set of rollers mountable on an upper side of said line.

37. An apparatus according to claim 36 wherein each of said rollers is provided with an annular groove receiving said line when said apparatus is in an operational mode.

38. An apparatus according to claim 35 wherein said centering means includes a set of rollers engageable with sides of said line when said apparatus is positioned adjacent said line in straddling relation.

39. An apparatus according to claim 38 wherein each of said rollers is provided with an annular groove adapted to receive said line when said rollers engage said line.

40. An apparatus according to claim 1 wherein said main frame includes a longitudinally disposed opening in a lower end thereof for receiving said line therethrough.

41. An apparatus according to claim 1 wherein said main frame is engageable with said line for aligning said track assemblies with said line.

42. An apparatus for forming a trench in the bed of a body of water for burying a line lying therealong comprising:

a main frame;

a pair of endless track assemblies, each engageable in gripping relation with a side of said line when said apparatus is in an operational mode for propelling said frame along said line; and means mounted on said main frame for dislodging portions of said bed when said apparatus is in said operational mode and said track assemblies engage said line and propel said main frame along said line to form said trench and allow said line to fall therein.

43. An apparatus according to claim 42 including means for educting spoils produced by the dislodgement of bed material by said dislodging means.

* * * * *

UNITED STATES PATENT AND TRADEMARK OFFICE

CERTIFICATE OF CORRECTION

PATENT NO. : 6,705,029 B2
DATED : March 16, 2004
INVENTOR(S) : Richard A. Anderson It is certified that error appears in the above-identified patent and that said Letters Patent is hereby corrected as shown below:

Column 10,
Line 8, insert -- of -- between "out" and "engagement"
Lines 16-17, please delete "said operational mode" and insert -- an operational mode" in lieu thereof Column 11,
Line 1, please delete "said buoyancy tank" and insert -- said at least one buoyancy tank -- in lieu thereof
Lines 2-3, please delete "said buoyancy tanks" and insert -- said at least one buoyancy tank -- in lieu thereof Signed and Sealed this Eighteenth Day of May, 2004

JON W. DUDAS
*Acting Director of the United States Patent and Trademark Office*